US007404867B2

(12) United States Patent
Koch

(10) Patent No.: US 7,404,867 B2
(45) Date of Patent: Jul. 29, 2008

(54) INFRARED DECOY FLARE COMPOSITION

(75) Inventor: Ernst-Christian Koch, Kaiserslautern (DE)

(73) Assignee: Diehl BGT Defence GmbH & Co., KG, Überlingen (DE)

( * ) Notice: Subject to any disclaimer, the term of this patent is extended or adjusted under 35 U.S.C. 154(b) by 274 days.

(21) Appl. No.: 11/211,812

(22) Filed: Aug. 25, 2005

(65) Prior Publication Data

US 2007/0251617 A1 Nov. 1, 2007

(30) Foreign Application Priority Data

Sep. 11, 2004 (DE) ..... 10 2004 043 991

(51) Int. Cl.

| | |
|---|---|
| ***C06B 25/00*** | (2006.01) |
| ***C06B 25/34*** | (2006.01) |
| ***C06B 25/26*** | (2006.01) |
| ***C06B 25/12*** | (2006.01) |
| ***D03D 23/00*** | (2006.01) |
| ***F42B 1/00*** | (2006.01) |

(52) U.S. Cl. ..... 149/105; 149/88; 149/92; 149/98; 149/102; 149/108.4; 102/301

(58) Field of Classification Search ..... None
See application file for complete search history.

(56) References Cited

U.S. PATENT DOCUMENTS

| | | | | |
|---|---|---|---|---|
| 2,988,435 | A | 6/1961 | Stanley et al. | |
| 3,017,301 | A | 1/1962 | Engelhardt | |
| 3,117,044 | A | 1/1964 | Sauer | |
| 5,861,571 | A * | 1/1999 | Scheffee et al. | 102/288 |
| 6,427,599 | B1 | 8/2002 | Posson et al. | |
| 6,730,181 | B1 * | 5/2004 | Sanderson et al. | 149/19.92 |
| 2002/0157557 | A1 | 10/2002 | Cesaroni et al. | |
| 2004/0011235 | A1 | 1/2004 | Callaway et al. | |

* cited by examiner

*Primary Examiner*—Jerry A. Lorengo
*Assistant Examiner*—James E McDonough
(74) *Attorney, Agent, or Firm*—Scully, Scott, Murphy & Presser, P.C.

(57) ABSTRACT

An infrared decoy flare composition for generating infrared radiation, including a fuel, an oxidizing agent and a binder, wherein the decoy flare composition contains no metals or metal-containing compounds and no halogens or halogen-containing compounds. Such an infrared decoy flare composition can be particularly advantageously used in aerial infrared decoy flares for civil aircraft.

12 Claims, 1 Drawing Sheet

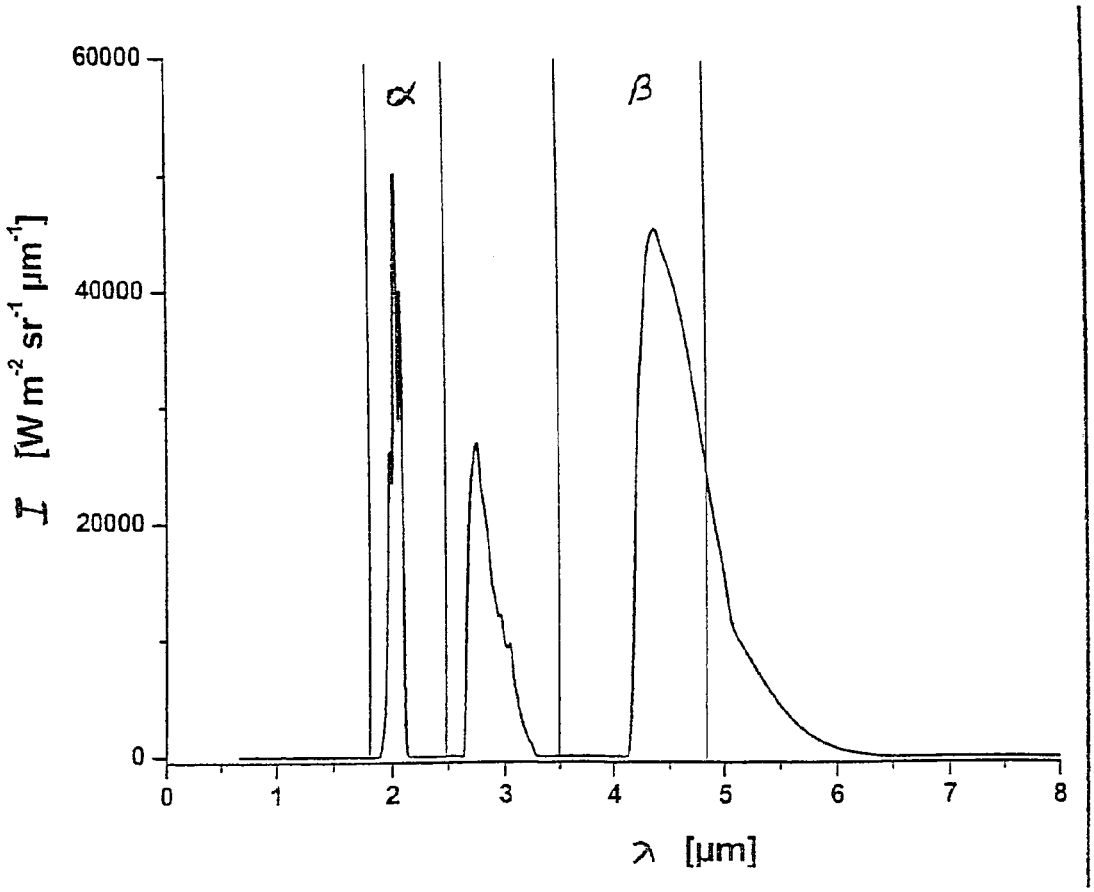
60000
40000
20000
0
I [W m-2 sr-1 µm-1]
α
β
0
1
2
3
4
5
6
7
8
λ [µm]

INFRARED DECOY FLARE COMPOSITION

BACKGROUND OF THE INVENTION

1. Field of the Invention

The present invention relates to an infrared decoy flare composition material for generating infrared radiation, which can advantageously be applied in an aerial infrared decoy flare.

In the military sector, missiles, such as air-to-air and surface-to-air guided missiles, which head for and pursue infrared (IR) radiation emitted by the target, chiefly in the range between 0.8 and 5 μm, with the aid of a seeker head sensitive to IR radiation, are used for combating air targets, such as, for example, jet aircraft, helicopters and transport machines. For defence against these missiles, flares which imitate the IR signature of the target are therefore used in order to deflect approaching guided missiles. Such flares can also be used in the pre-emptive release mode in order to complicate or even prevent the detection of targets by reducing the contrast of the scene.

Pyrotechnical infrared (IR) flares are typically used in military scenarios. Recently, however, civil aircraft, too, are being threatened by IR-guided missiles. Civil aircraft are at risk in particular from so-called MANPADS (Man Portable Air Defence Systems). Typical MANPADS constituting an asymmetrical threat to civil aircraft are, for example, the SA-7, SA-14, SA-16, SA-18 and the STINGER models Basic, POST and RMP.

In contrast to military aircraft, it is believed that civil aircraft are threatened only during takeoff and landing. A threat at flying altitude (>10 000 m) would also be conceivable, but this would require weapons systems which are not directly available to terrorists, at least in peaceful regions and furthermore cannot be used with the necessary camouflage, as is the case with MANPADS. The threat to civil aircraft during takeoff and landing is particularly precarious because, in contrast to more agile small military platforms, a passenger aircraft is not capable of making tactical manoeuvres during flight in order to escape a recognized threat. In addition, an aircraft taking off has a particularly intense IR signature, which facilitates lock-on of a seeker head.

Since the time window available for the protection of civil aircraft is therefore very limited, pyrotechnical IR flares are the preferred countermeasures in the combating of IR-controlled missiles.

2. Discussion of the Prior Art

Conventional IR flares for military applications are, however, characterized by certain features which complicate use for the scenario described above.

Thus, the pyrotechnical compositions of conventional IR flares burn with strong commission of both visible light and smoke. Since the ejection of flares and the visibility of this measure can lead to panic among the passengers on the ground and in the air, the visual signature of such flares should be as small as possible during the day and during the night. Furthermore, it is to be feared that ejected flares may fall to the ground while burning and may cause fires there. Typical charges have a combustion time of more than 3.5 seconds, so that flares ejected close to the ground can easily fall onto the runway or in the environment of the airport while still burning.

The disadvantages of known spectrally adapted active compositions for IR flares for use for detecting civil aircraft are therefore high luminous intensity in the visual range when metals are used as performance-enhancing additives, visible traces of smoke due to the formation of condensed products, and danger of fire on the ground due to a long duration of combustion of the pyrotechnic payload.

BRIEF DESCRIPTION OF DRAWING

FIG. 1, is a spectral graph showing the Infra-Red emission spectra of the claimed composition.

SUMMARY OF THE INVENTION

Starting from the problems described above with conventional infrared flares, it is therefore the object of the invention to provide an infrared decoy flare composition which is suitable for infrared decoy flares for aerial protecting civil aircraft. In particular, the infrared decoy flare composition should have only a low luminous intensity in the visual range and should produce little smoke.

This object is achieved by an infrared decoy flare composition, which comprises a fuel, an oxidizing agent and a binder, and in which the infrared decoy flare composition does not contain any metals or metal-containing compounds, halogens or halogen-containing compounds.

The infrared decoy flare composition for producing infrared radiation contains a fuel, an oxidizing agent and a binder, in contrast to conventional infrared phosphorescent materials, but, according to the invention, no metals or metal-containing compounds and no halogens or halogen-containing compounds. Since the infrared decoy flare composition contains no halogens or halogen-like compounds, the formation of hygroscopic HCl is prevented; in other words, visible smoke formation is suppressed or minimized. Owing to the lack of metals or metal-containing compounds, the signature of the infrared decoy flare composition in the visible range and in the near infrared range is substantially minimized.

DETAILED DESCRIPTION OF THE INVENTION

The fuel of the infrared decoy flare composition is preferably selected from the group consisting of cyano compounds which are hydrogen free or have a low hydrogen content and nitro or nitramin compounds, the hydrogen content of which is preferably not more than about 50% by weight. For example, the fuel may be an aliphatic, olefinic or aromatic cyano compound of the general composition $C_nH_m(CN)_x$. Particularly preferably, the fuel is selected from the group consisting of hexacyanobenzene and nitro cyanobenzenes. These fuels burn without a recognizable smoke signature and with only low radiant intensity in the visible range.

In a development of the invention, the fuel is contained in the infrared decoy flare composition according to the invention in a proportion by mass of about 10% by weight to about 55% by weight, more preferably of about 10% by weight to about 35% by weight.

In the infrared decoy flare composition according to the invention, an oxidizing agent which itself has no smoke formation and no emission in the visible range and near infrared range is used. Typical examples of such a low-signature oxidizing agent are, e.g., hexanitroethane (HNE) $C_2(NO_2)_6$, ammonium dinitramide (ADN) $NH_4N(NO_2)_2$ and hydrazinium nitroformate (HNF) $C(NO_2)_3N_2H_5$.

Further suitable oxidizing agents are substances of the general composition $C_xH_yN_zO_m$, having a positive oxygen balance of at least about 15% by weight, ideally at least about 25% by weight. The oxygen balance describes the proportion by mass of available oxygen after the formal oxidation of combustible components of the compound, such as H and C.

It is a feature of the invention that the oxidizing agent contains no halogens, in order to prevent the formation of, e.g., hygroscopic HCl. Furthermore, the charge according to the invention contains no alkali or alkaline earth metal baxel compounds in order as far as possible to minimize the signature in the visible and near infrared range.

The oxidizing agent is preferably contained in the infrared decoy flare composition according to the invention in a proportion by mass of about 40% by weight to about 85% by weight, particularly preferably of about 55% by weight to about 85% by weight.

For example, polynitropolyphenylenes (PNP) and glycidyl azide polymer (GAP) are used as binders. These materials are high-energy and at the same time insensitive binders which have a good oxygen balance of the active composition and at the same time burn without producing soot and without a noteworthy signature in the visible range. The high-energy binder also serve the acceleration of the combustion rate, conventionally achieved by the addition of thermally conducting metals.

The binder is preferably contained in the infrared decoy flare composition material of the invention in a proportion by mass of about 1.5% by weight to about 5% by weight.

A further feature of the invention is the consideration of dimensioning the charge in a munition so that no total combustion times of more than 1.5 seconds are reached. This is effected, for example, through the choice of a sufficiently large ratio of surface to volume of the infrared decoy flare composition of at least about 4.

The decoy flare composition of the invention which is described above can advantageously be used in an aerial infrared decoy flare for a civil aircraft. This is the case in particular because, on combustion, the infrared decoy flare composition according to the invention produces no visual effect, i.e. there is no smoke formation and only a very low radiant intensity in the visible range.

The attached figure shows, by way of example, the radiance I as a function of the wavelength $\lambda$ for an infrared phosphorescent material based on 35% by weight of hexacyanobenzene, 60% by weight of hexanitroethane and 5% by weight of polynitropolyphenylene. The phosphorescent material shows a strong selective emission between 3 and 5 μm (so-called β-band) and also between 2 and 3 μm (so-called α-band), i.e. simulates the signature of an aircraft engine well.

The invention claimed is:

1. An infrared decoy flare composition comprising:

a fuel, an oxidizing agent and a binder, wherein the infrared decoy flare composition generates infrared radiation and contains no metals or metal-containing compounds and no halogens or halogen-containing compounds, said fuel is selected from the group consisting of hexacyanobenzene and nitrated cyanobenzenes.

2. The infrared decoy flare composition according to claim 1, wherein the fuel is contained in a proportion of about 10% by weight to about 55% by weight.

3. The infrared decoy flare composition according to claim 1, wherein the fuel is contained in a proportion of about 10% by weight to about 35% by weight.

4. The infrared decoy flare composition according to claim 1, wherein the oxidizing agent is selected from the group consisting of hexanitroethane, ammonium dinitramide and hydrazinium nitroformate.

5. The infrared decoy flare composition according to claim 1, wherein the oxidizing agent is a substance of the general composition $C_xH_yN_zO_m$.

6. The infrared decoy flare composition according to claim 5, wherein the oxygen balance of the oxidizing agent is at least about 50% by weight.

7. The infrared decoy flare composition according to claim 1, wherein the oxidizing agent is contained in a proportion of about 40% by weight to about 85% by weight.

8. The infrared decoy flare composition according to claim 7, wherein the oxidizing agent is contained in a proportion of about 55% by weight to about 85% by weight.

9. The infrared decoy flare composition according to claim 1, wherein the binder is selected from the group consisting of polynitropolyphenylene and glycidyl azide polymer.

10. The infrared decoy flare composition according to claim 1, wherein the binder is contained in a proportion of about 1.5% by weight to about 5% by weight.

11. The infrared decoy flare composition according to claim 1, wherein said infrared decoy flare composition has emissions between 3 and 5 μm and 2 and 3 μm.

12. An infrared decoy flare composition comprising: 35% by weight hexacyanobenzene, 60% by weight hexanitroethane and 5% by weight polynitropolyphenylene, wherein the infrared decoy flare composition generates infrared radiation, has emissions between 3 and 5 μm and 2 and 3 μm and contains no metals or metal-containing compounds and no halogens or halogen-containing compounds.

* * * * *